US008220090B2

(12) United States Patent
Gowda

(10) Patent No.: US 8,220,090 B2
(45) Date of Patent: Jul. 17, 2012

(54) MULTI-CHAMBER AIR DISTRIBUTION SUPPORT SURFACE PRODUCT AND METHOD

(75) Inventor: Raj K. Gowda, Corona, CA (US)

(73) Assignee: KAP Medical, Corona, CA (US)

( * ) Notice: Subject to any disclaimer, the term of this patent is extended or adjusted under 35 U.S.C. 154(b) by 348 days.

(21) Appl. No.: 11/553,405

(22) Filed: Oct. 26, 2006

(65) Prior Publication Data

US 2008/0098532 A1 May 1, 2008

(51) Int. Cl.
*A61G 7/057* (2006.01)
*A47C 27/10* (2006.01)

(52) U.S. Cl. ..... 5/713; 5/423; 5/726; 5/710

(58) Field of Classification Search ..... 5/706, 710–714, 5/726, 421, 423, 689
See application file for complete search history.

(56) References Cited

U.S. PATENT DOCUMENTS

| | | | | | |
|---|---|---|---|---|---|
| 3,757,366 | A | | 9/1973 | Sacher | |
| 4,225,989 | A | | 10/1980 | Corbett et al. | |
| 4,267,611 | A | | 5/1981 | Agulnick | |
| 4,347,633 | A | | 9/1982 | Gammons et al. | |
| 4,391,009 | A | | 7/1983 | Schild et al. | |
| 4,631,767 | A | * | 12/1986 | Carr et al. | 5/714 |
| 4,653,130 | A | | 3/1987 | Senoue et al. | |
| 4,694,521 | A | * | 9/1987 | Tominaga | 5/689 |
| 4,944,060 | A | | 7/1990 | Peery et al. | |
| 5,010,609 | A | | 4/1991 | Farley | |
| 5,103,519 | A | | 4/1992 | Hasty | |
| 5,370,439 | A | | 12/1994 | Lowe et al. | |
| 5,375,273 | A | | 12/1994 | Bodine, Jr. et al. | |
| 5,509,155 | A | | 4/1996 | Zigarac et al. | |
| 5,755,000 | A | * | 5/1998 | Thompson | 5/713 |
| 5,802,645 | A | * | 9/1998 | Vrzalik | 5/710 |
| 5,817,391 | A | * | 10/1998 | Rock et al. | 428/86 |
| 5,870,785 | A | * | 2/1999 | Hoorens | 5/652.1 |
| 5,926,884 | A | * | 7/1999 | Biggie et al. | 5/714 |
| 6,073,291 | A | * | 6/2000 | Davis | 5/711 |
| 6,085,372 | A | * | 7/2000 | James et al. | 5/713 |
| 6,148,461 | A | * | 11/2000 | Cook et al. | 5/713 |
| 6,618,884 | B1 | * | 9/2003 | Wu | 5/706 |
| 6,782,574 | B2 | * | 8/2004 | Totton et al. | 5/713 |
| 6,898,809 | B2 | * | 5/2005 | Davis | 5/81.1 R |

(Continued)

OTHER PUBLICATIONS

International Search Report for International Application No. PCT/US07/82674 dated Sep. 25, 2008.

*Primary Examiner* — Michael Trettel
(74) *Attorney, Agent, or Firm* — Faegre Baker Daniels LLP

(57) ABSTRACT

An air distribution support surface product includes a vapor permeable material such as a sheet of breathable material, a fluid resistant material, such as a sheet of waterproof material and an intermediate fluid passing material interposed between the vapor permeable material and the fluid resistant material to form a plurality of chambers. One of the chambers serves as a type of fluid retention chamber and another chamber serves as a type of fluid loss chamber. A fluid intake opening may be provided to allow fluid, such as air, to inflate the chambers. In one example, both of the chambers share the intermediate fluid passing material. As such, the fluid retention chamber is formed by the fluid resistant material and the intermediate fluid passing material. The fluid loss chamber is formed by the vapor permeable material and the intermediate fluid passing material.

23 Claims, 7 Drawing Sheets

U.S. PATENT DOCUMENTS 7,100,978 B2 * 9/2006 Ekern et al. ..... 297/180.11
7,373,680 B2 * 5/2008 Davis ..... 5/711
7,376,995 B2 * 5/2008 Davis ..... 5/710
7,469,432 B2 * 12/2008 Chambers ..... 5/423
2005/0022308 A1 2/2005 Totton et al.
2008/0022461 A1 * 1/2008 Bartlett et al. ..... 5/714

* cited by examiner

MULTI-CHAMBER AIR DISTRIBUTION SUPPORT SURFACE PRODUCT AND METHOD

FIELD OF THE INVENTION

The invention relates generally to air distribution support surface products such as low air loss support surface products that have a surface that comes in contact with a user's skin or clothing.

BACKGROUND OF THE INVENTION

Air distribution support surface products may be pads that may be placed on mattresses, chairs, or other support surfaces. Known air distribution support surfaces typically have small holes in an outer sheet that allow the passing of vapor, such as air, that is supplied by a pump to the air distribution support surface. Air distribution support surfaces may prevent and cure users prone to or suffering from decubitus ulcers, and also with respiratory complications by loosening fluids in the lungs, and attempt to remove moisture away from a user's skin to help prevent discomfort such as bed sores, pressure sores, ulcers or other problems. As such, they may help prevent skin macerations and high pressure points on a patient's or any end user's skin. Air distribution support surfaces are also known to include attachment structures (e.g., a zipper) to allow the air distribution support surface to be zipped to a mattress cover or other support surface. Mattresses may be solid foam mattresses, air cell based mattresses or any other suitable support surfaces.

Pressure inflatable support surfaces are also known to help in the prevention of skin breakdown and are sometimes referred to as "low air loss" systems which attempt to circulate a low amount of air beyond normal air convection to remove moist air vapor given off by a patient to keep the patient dry and promote healing. Such air distribution support surface products include, for example, a single chamber that is inflatable and have a top sheet with small holes or other vapor permeable features to allow air that is placed into the air distribution support surface to escape toward the patient's skin. A bottom sheet may be a quilted synthetic sheet covered on the inside with a type of urethane undercoat which may be vapor permeable to allow, for example, water vapor molecules to pass through but forms a waterproof barrier to prevent water from flowing through apertures in the top sheet from passing entirely through the air distribution support surface product. The sheets are sewn about a periphery to create a single low air loss chamber that allows air to pass up through the apertures in the top sheet while substantially preventing air flow through the bottom. However, when a patient lays on such a type of device, the weight of the patient can cause the top sheet to fully compress in parts under the patient to come in contact with the inner surface of the bottom layer preventing suitable air flow within the chamber. This can result in reduced air flow coming from the inflatable top sheet thereby reducing its impact and ability to assist in improving the user's condition.

In addition, such single chambered devices may also employ a simple inlet tube structure that may be, for example, only several inches long which enters through an opening into the chamber to allow the coupling of an air hose from a low air loss air supply. Such inlet tubes, however, are positioned at the end or foot of the inflatable sheet and may be inadvertently cut off by the weight of a patient's or by a user's foot when laying on top of the sheet. This construction may fail to adequately provide air throughout the inflatable sheet since it only provides a single air dispensing point within the single chambered low air loss inflatable sheet. Other disadvantages will be recognized by those of ordinary skill in the art.

Known air distribution support surface products however, may not provide adequate therapeutic results since when a patient lays on top of the air distribution support surface product, the weight of the user can compress the air distribution support surface product to a point that may undesirably restrict air flow in the product reducing the impact of the air flow from the air distribution support surface product.

Accordingly, a need exists for an improved air distribution support surface product and method that overcomes one or more of the above drawbacks.

BRIEF DESCRIPTION OF THE DRAWINGS

The invention will be more readily understood in view of the following description when accompanied by the figures below and wherein like reference numerals represent like elements.

DETAILED DESCRIPTION OF THE DISCLOSURE

Figure 1:
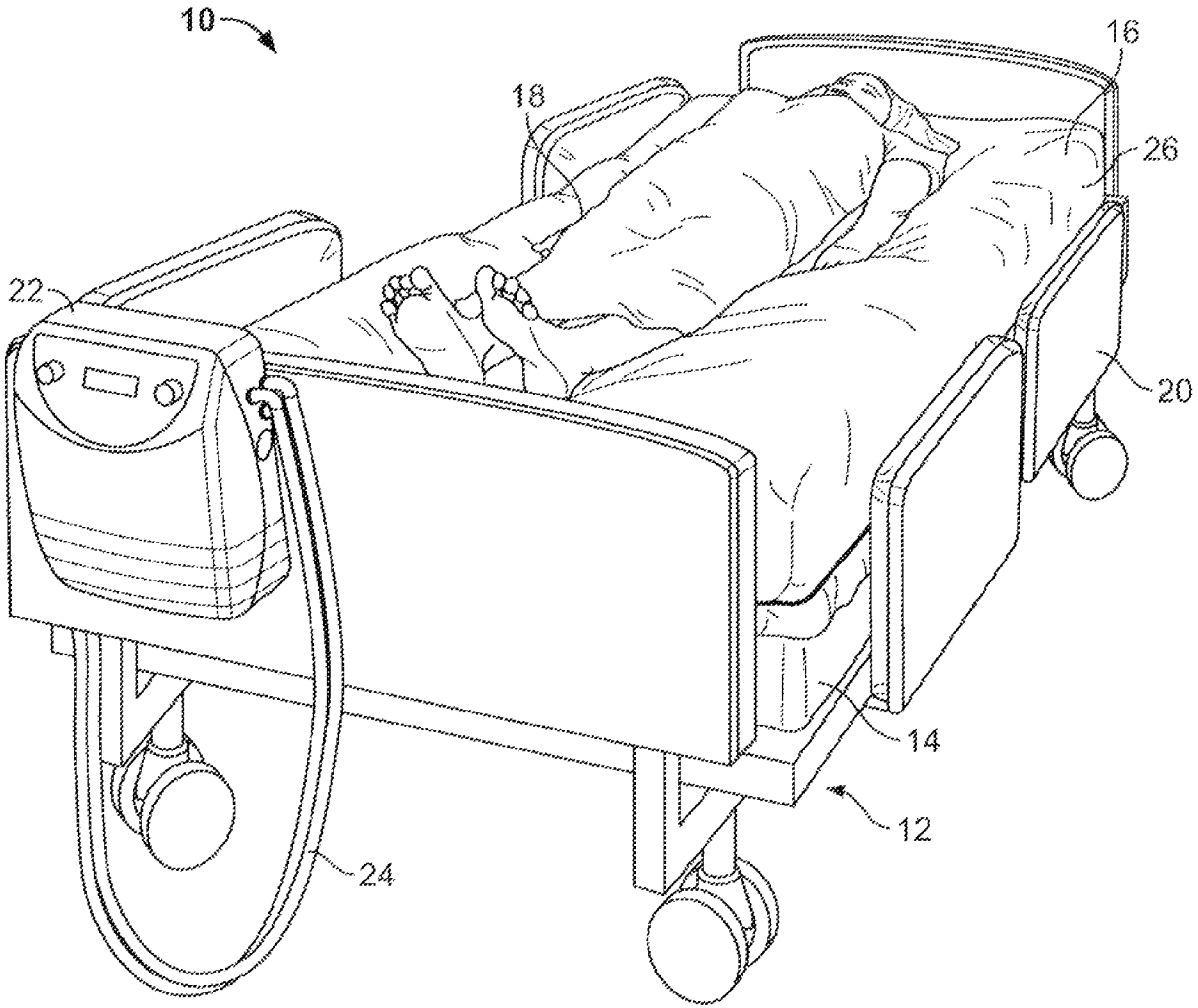
FIG. 1 is a perspective view illustrating one example of a bed employing an air distribution support surface product in accordance with one embodiment of the invention when a user is in contact with an outer surface of the air distribution support surface product.

Generally, an air distribution support surface product includes a vapor permeable material such as a sheet of breathable material, a fluid resistant material, such as a sheet of waterproof material and an intermediate fluid passing material interposed between the vapor permeable material and the fluid resistant material to form a plurality of chambers. One of the chambers serves as a type of fluid retention chamber and another chamber serves as a type of fluid loss chamber. A fluid intake opening may be provided to allow fluid, such as air, to inflate the chambers. In one example, both of the chambers share the intermediate fluid passing material. As such, the fluid retention chamber is formed by the fluid resistant material and the intermediate fluid passing material. The fluid loss chamber is formed by the vapor permeable material and the intermediate fluid passing material.

When fluid is provided to the air distribution support surface product, the fluid resistant material which may be, for example, a bottom surface, prevents air from flowing from the bottom but the intermediate fluid passing portion allows the air to flow from the fluid retention chamber into the fluid loss chamber. The vapor permeable material in the fluid loss chamber allows air to pass from the air distribution support surface product to a user that is in contact or proximate to the air distribution support surface product.

In one example, a fluid dispensing structure is placed inside the air distribution support surface product to allow distributed inflation of the fluid retention chamber via one or more fluid intake openings. Also in one example, the intermediate fluid passing material is a compressible material that separates the two chambers. Among other advantages, the compressible material can allow suitable comfort for the user but also includes air openings therein that provide cross dispersion of fluid from the fluid retention chamber to pass to the fluid loss chamber in addition to allowing air to flow in an outward manner, and crossways manner if desired, from the fluid retention chamber. A method of making an air distribution support surface product is also disclosed.

In one example, an air distribution support surface product may serve as a bed top sheet, top cover or mattress pad or may be used for any other suitable purpose and in one example, employs a vapor permeable nylon sheet that is attached around its periphery with a fluid resistant nylon sheet and an intermediate fluid passing sheet interposed between the vapor permeable sheet and the fluid resistant sheet to form a plurality of chambers. The intermediate fluid passing sheet in one example, is made of a compressible material and has a thickness greater than the thickness of the vapor permeable nylon sheet and the fluid resistant nylon sheet. An attachment structure is coupled to the vapor permeable nylon sheet and the intermediate fluid passing sheet (also referred to as a top sheet assembly) which is attachable and detachable to a corresponding attachment structure coupled to the fluid resistant nylon sheet. The fluid resistant nylon sheet is removable from the top sheet assembly for laundering or service of the top sheet assembly. An air distribution hose serving as the air distribution structure is installed within the top sheet assembly and arranged in one example, in a U shape held by support sleeves in the top sheet assembly. The U shapes hose or tube includes holes to allow air to pass from the tubing into a chamber. A base of the air distribution structure includes a stub hose with a connector for coupling to a source of pressurized air from an external pump. The pump provides low pressurized air and the holes within the tube inflate the air distribution support surface product.

FIG. 1 illustrates one example of a bed 10 that includes a mattress support structure 12, such as a frame, a mattress 14 that is supported by the mattress support structure and an air distribution support surface product 16. In this example, the air distribution support surface product 16 serves as a type of inflatable top sheet for the user 18. Also in this example, the bed includes side safety panels 20 and end safety panels as known in the art and also includes a programmable air supply source 22 such as a programmable low air loss pump as known in the art. The programmable air supply 22 provides low pressure air through one or more tubes 24 to the air distribution support surface product 16. It will be recognized, however, that any suitable bed structure may employed as desired including the mattress 14 being a foam mattress, an air mattress that includes a plurality of sealed air cells as known in the art, or any other suitable structure. The programmable air supply source 22 need not be programmable and may be any suitable pump or other fluid supply source as desired. By way of example only, such a fluid supply source 22 may be of a type sold by Kap Medical, Inc. located in Corona, Calif., USA, or any other suitable air supply source.

As shown, an outer surface 26 of the air distribution support surface product 16 is in contact with the user and provides a type of low air loss top sheet on which the user 18 may lay. However, it will be recognized that the air distribution support surface product 16 may be used on a chair or other surface and may be sized to be of any desirable shape or configuration depending upon the need of a user.

Figure 2:
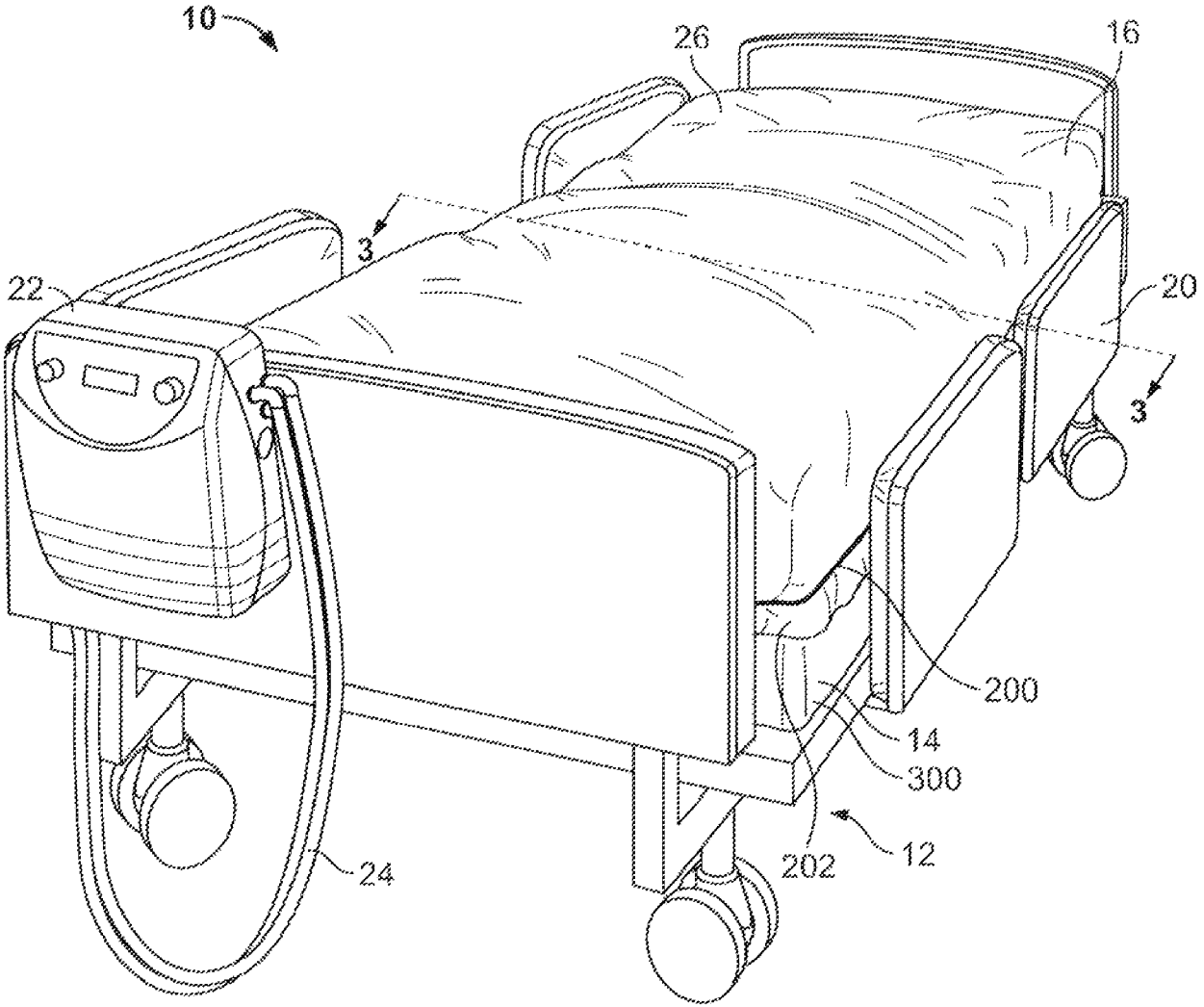
FIG. 2 is a perspective view of the bed of FIG. 1 without the patient showing an inflated air distribution support surface product in accordance with one embodiment of the invention.

FIG. 2 illustrates the bed 10 of FIG. 1 without the user 18. As shown, the air distribution support surface product 16 is in an inflated condition. The air distribution support surface product 16 includes a seam 200 and an overlap portion 202 which overlaps with a top portion of the mattress 14. In one example, the seam 200 is located around a periphery of the air distribution support surface product 16 to secure the various materials together as needed. However, any suitable attachment technique may be employed.

Figure 3:
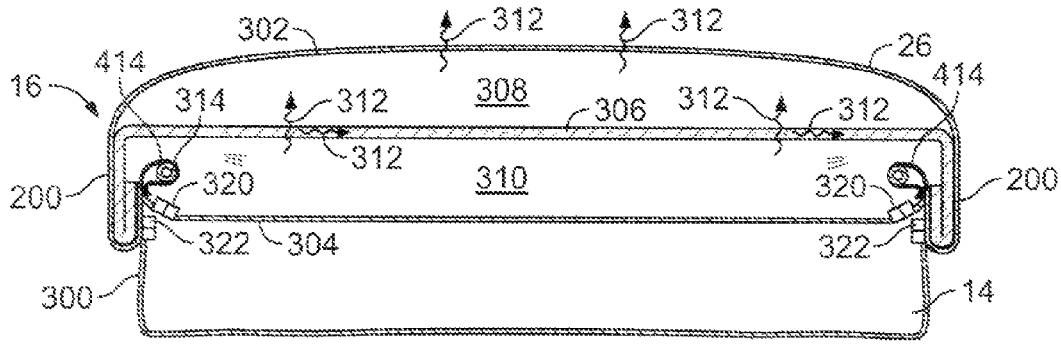
FIG. 3 is a cross sectional view of a portion of FIG. 1 illustrating one example of an air distribution support surface product in accordance with one embodiment of the invention.

FIG. 3 is a cross sectional view showing one example of the air distribution support surface product 16 connected with a mattress cover 300 such as a nylon mattress cover that covers the mattress 14. The air distribution support surface product 16 includes a vapor permeable material 302, such as breathable nylon material or any other suitable material, a fluid resistant material 304, such as a urethane coated nylon material, or any other fluid resistant material, and an intermediate fluid passing material 306 that is interposed between the vapor permeable material 302 and the fluid resistant material 304 to form a plurality of chambers 308 and 310. It will be recognized that the vapor permeable material, fluid resistant material and intermediate fluid passing material may be each fabricated using one or more layers of suitable materials to form a sheet of each respective material. However, any other suitable structure may be employed. In this example, the fluid resistant material 304, the intermediate fluid passing material 306 and the vapor permeable material 302 are in sheet form. The sheets are layered and then attached about their respective peripheries via seam 200. However, it will be recognized that any suitable attachment scheme or locations may be used so that if sheets are used they may be attached at any suitable portions thereof or locations thereof as desired.

The chamber 308 is a fluid loss chamber formed by the vapor permeable material 302 and the intermediate fluid passing material 306. The chamber 310 is a fluid retention chamber formed by the fluid resistant material 304 and the intermediate fluid passing material 306. As such, in this example, the intermediate fluid passing material serves as a shared wall to both of the respective chambers 308 and 310. However, it will be recognized that other intermediate materials or layers may also be employed if desired. The intermediate fluid passing material 306, in one example, is a compressible material that has a thickness greater than a thickness of both the vapor permeable material and the fluid resistant material 304. However it will be recognized that the intermediate fluid passing material 306 may be made of any suitable material such as, for example, the vapor permeable material 302 with additional perforations therein to allow fluid to pass from chamber 310 to chamber 308. One example of suitable intermediate fluid passing material may be AirX™ spacer fabric sold by TYTEX Ortho Car, TYTEX Inc., Woonsocket, R.I., however it will be recognized that any suitable material may also be employed. The vapor permeable material may be, for example, a sheet of breathable nylon such as type FSTXP601 Soft-Tex Plus sold by Brookwood Companies Inc., Brookwood Roll Goods, Gardena, Calif., however any suitable material can be used. The fluid resistant material may be a PVC coated nylon such as Chemtick, Hicksville, N.Y., however any suitable material may be used.

As shown, when the air distribution support surface product 16 is inflated, fluid passes from the fluid retention chamber 310 to the fluid loss chamber 308 and through the vapor permeable material 302 to provide a type of low air loss support surface having multiple chambers. The air flow is shown by the arrows generally indicated as 312.

The air distribution support surface product 16, in one example, also includes a fluid dispensing structure 314 which in this example, is a U shaped tubing structure that is positioned about a periphery of the chambers. (See FIG. 4). The fluid dispensing structure 314 includes apertures that pass pressurized air to fill the air distribution support surface product.

As also shown in FIG. 3, the vapor permeable material 302 serves as a type of top sheet (meaning that it is the sheet closest to the user) and the fluid resistant material 304 can serve as a bottom sheet (furthest away from the user). The air distribution support surface product 16 also includes a top sheet assembly attachment structure 320 shown in this example to be a zipper that is adapted to attach/detach to the fluid resistant material 304. In this way, the fluid resistant material 304 may be removed so that the vapor permeable material 302 and fluid resistant material 304 can be washed as a separate assembly or unit. The air distribution support surface product 16, in this example, also includes another top sheet assembly attachment structure 322 shown in this example to be part of a zipper structure that is adapted to attach to a support surface cover 300 or to a support surface directly if desired. It will also be recognized that any suitable attachment structure may be employed such as buttons, Velcro™, snaps, or any other suitable attachment mechanism as desired. In addition, it will be recognized that the top sheet assembly attachment structure 322 and the top sheet attachment structure 320 need not be employed if desired.

Figure 4:
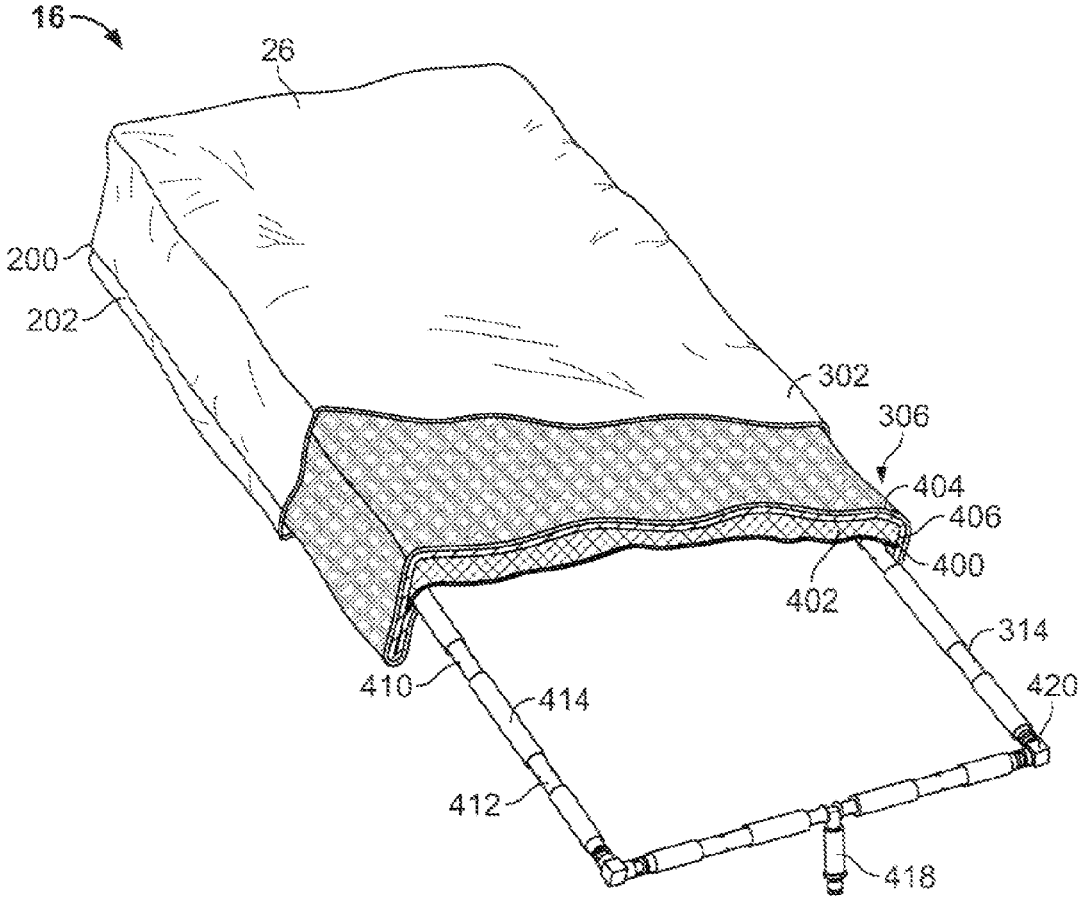
FIG. 4 is a cutaway view of one embodiment of an air distribution support surface product in accordance with one embodiment of the invention.

Referring also to FIG. 4, the air distribution support surface product 16 is shown without the fluid resistant material 304. A cutaway section of one example of the intermediate fluid passing material 306 is illustrated as well as one example of the fluid dispensing structure 314. In this example, the intermediate fluid passing material 306 is made up of several layers that form a compressible and air diffusion structure that allows both upward and sideways air flow from the fluid retention chamber to the fluid loss chamber. The intermediate fluid passing material in this example is also compressible to allow padding for additional comfort and for absorbing moisture if desired. However, it will be recognized that a non-compressible material and thin material may also be employed if desired. In the example shown, the intermediate fluid passing material includes a first surface 400 which is a layer of material having fluid openings 402 shown as diamond shaped fluid openings. An opposing second surface or layer 404 also includes fluid openings but that are smaller than the fluid openings 402. A fluid passing mesh material or layer 406 is interposed between the first and second surfaces.

The fluid dispensing structure 314 in this example, is located about a periphery of the fluid retention chamber (see also FIG. 3). The fluid dispensing structure 314 includes fluid passages 410 such as openings through tubing, to allow fluid to be dispensed from the fluid passage (e.g., tubing). In this example, the tube 412 is held in place through sleeves 414 which are attached (e.g., sewn) to the top sheet assembly and in this example, to an underside of chamber 308.

The fluid dispensing structure 412 is shown, in this example, to be in a U shape having a quick connect coupler portion 418 to connect with a hose 24 of the air supply unit 22. The fluid dispensing structure as shown includes the flexible tube 412 that defines the fluid openings 410 and the tube holding structure such as sleeve 414 holds the flexible tubing structure 412 within the fluid retention chamber 310. Among other advantages, the peripheral location of the fluid dispensing structure can allow for a more uniform and distributed inflation of the multi-chamber air distribution support surface product 16 and can help prevent the plugging problem that can be caused by a single opening and centrally located fluid intake structure of prior art products. Other advantages will also be recognized by those of ordinary skill in the art. Also shown are tube connectors 420 that connect multiple sections of tubing 412. However, it will be recognized that a single tube may be used or that any suitable structure may be employed.

For example, in an alternative embodiment, not only may a different non-peripheral configuration be employed, such as a T-shape, S-shape or any other suitable structure, but the tubing 412 may be removed and instead manifolds of the fluid resistant material 304 or other material may be sewn in as part of the structure and holes placed into the fluid resistant material so that a fabric based fluid dispensing structure is employed. In addition, as noted, the fluid dispensing structure, instead of being about a periphery, may also be instead located at a foot or end of the air distribution support surface product and may be an elongated manifold or tube with air holes therein to distribute air along a base or foot (or head) portion of an air distribution support surface. Other positions and configurations may also be employed as desired. Other alternatives will also be recognized by those of ordinary skill in the art.

Figure 5:
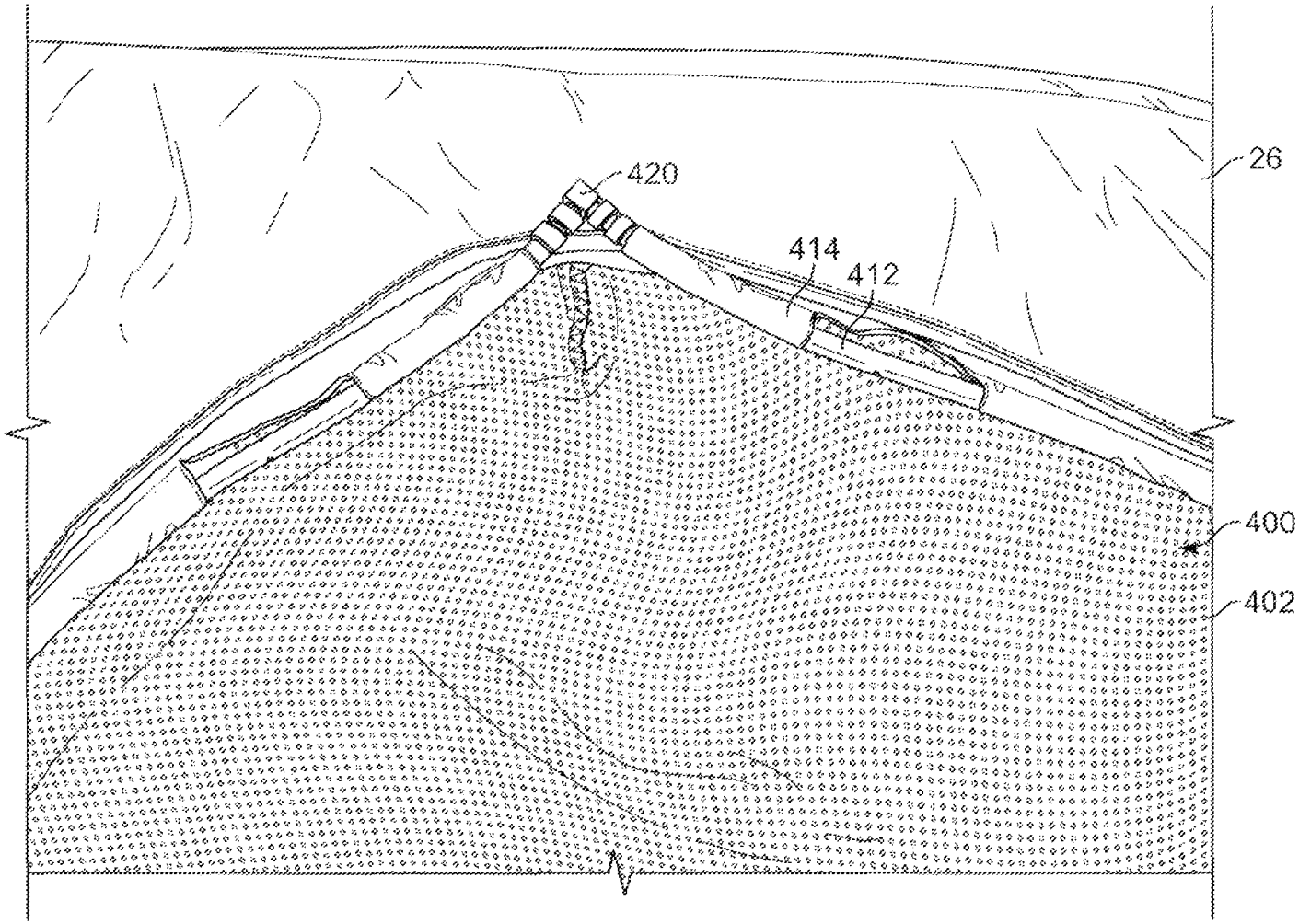
FIG. 5 is an illustration of one example of an air distribution support surface product in accordance with one embodiment of the invention having a corner thereof turned up to illustrate one example of a portion of the air distribution support surface product.

FIG. 5 illustrates in more detail, the sleeves 414 that serve as tube holding structures and shows a folded over portion of the air distribution support surface product 16 to illustrate also the first surface 400 with the air passages that help to create an intermediate fluid passing material. As shown in this example, the sleeves 414 are attached about the peripheral portions of the sheets of materials.

Figure 6:
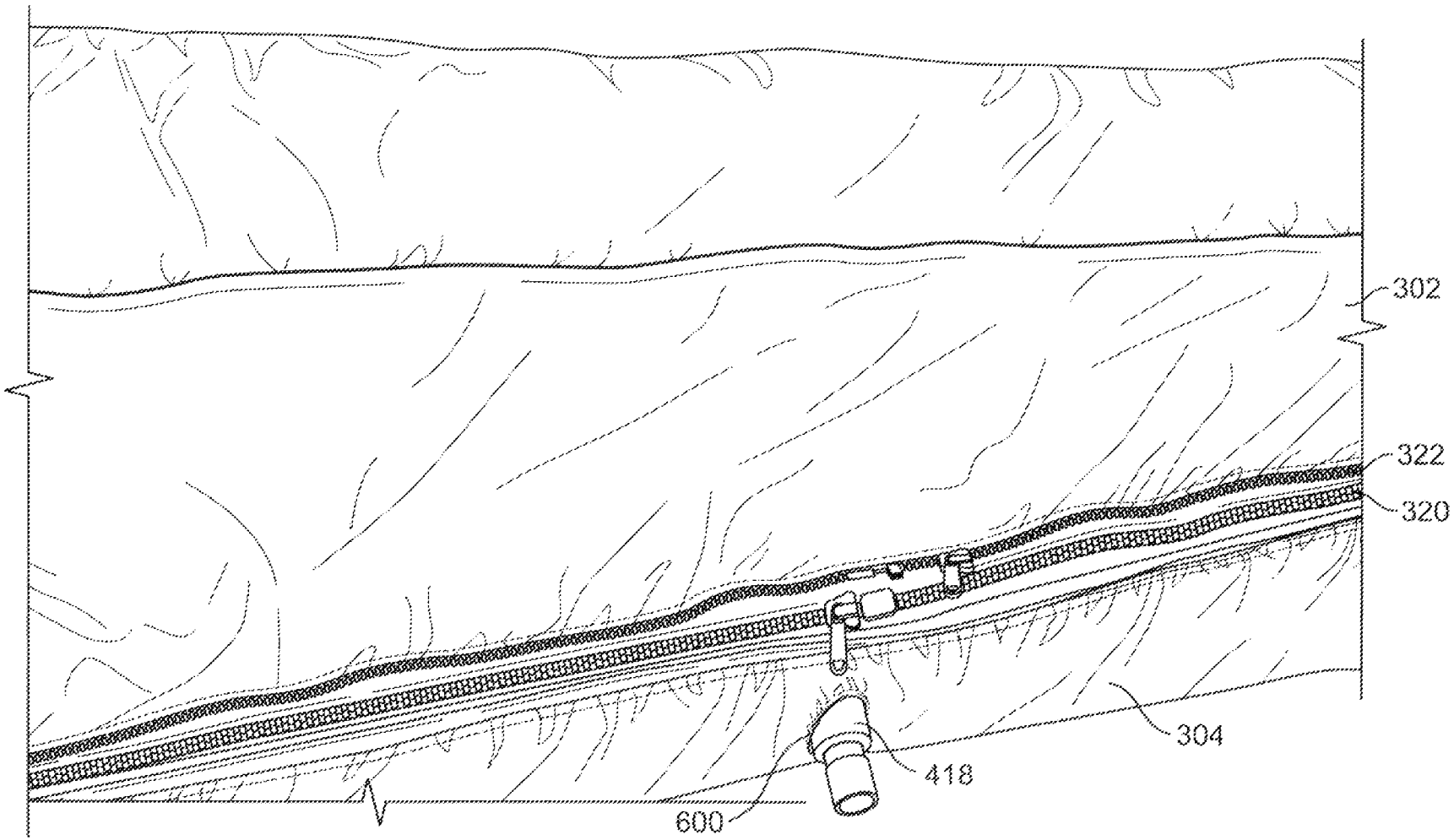
FIG. 6 is an illustration of a portion of an air distribution support surface product of FIG. 3 illustrating attachment mechanisms.

FIG. 6 illustrates in more detail the attachment structures that provide removable attachment in addition to a fluid intake opening 600 that provides fluid to at least one of the plurality of chambers 308 and 310, in this example by receiving the connector 418 which then passes fluid thereto to the tubing structure. In this example, the fluid intake opening 600 is located in the fluid resistant material 304, however it may also be located in the vapor permeable material 302 if desired.

In addition, as shown for example in FIG. 3, the sheets of material are attached (e.g., sewn) together about a periphery but it will be recognized that additional side panels of the same materials or different materials may also be employed to give the air distribution support surface product a different inflated shape if desired. It will also be recognized that portions of the vapor permeable material may be welded or fused to portions of the intermediate fluid passing material to reduce ballooning when the air distribution support surface product is inflated. Other enhancements will also be recognized by those of ordinary skill in the art.

Also, the vapor permeable material 302 and the intermediate fluid passing material 306 are a top sheet assembly in one example and the fluid resistant material 304 is removably attachable to the top sheet assembly via the attachment structures 320.

Figure 7:
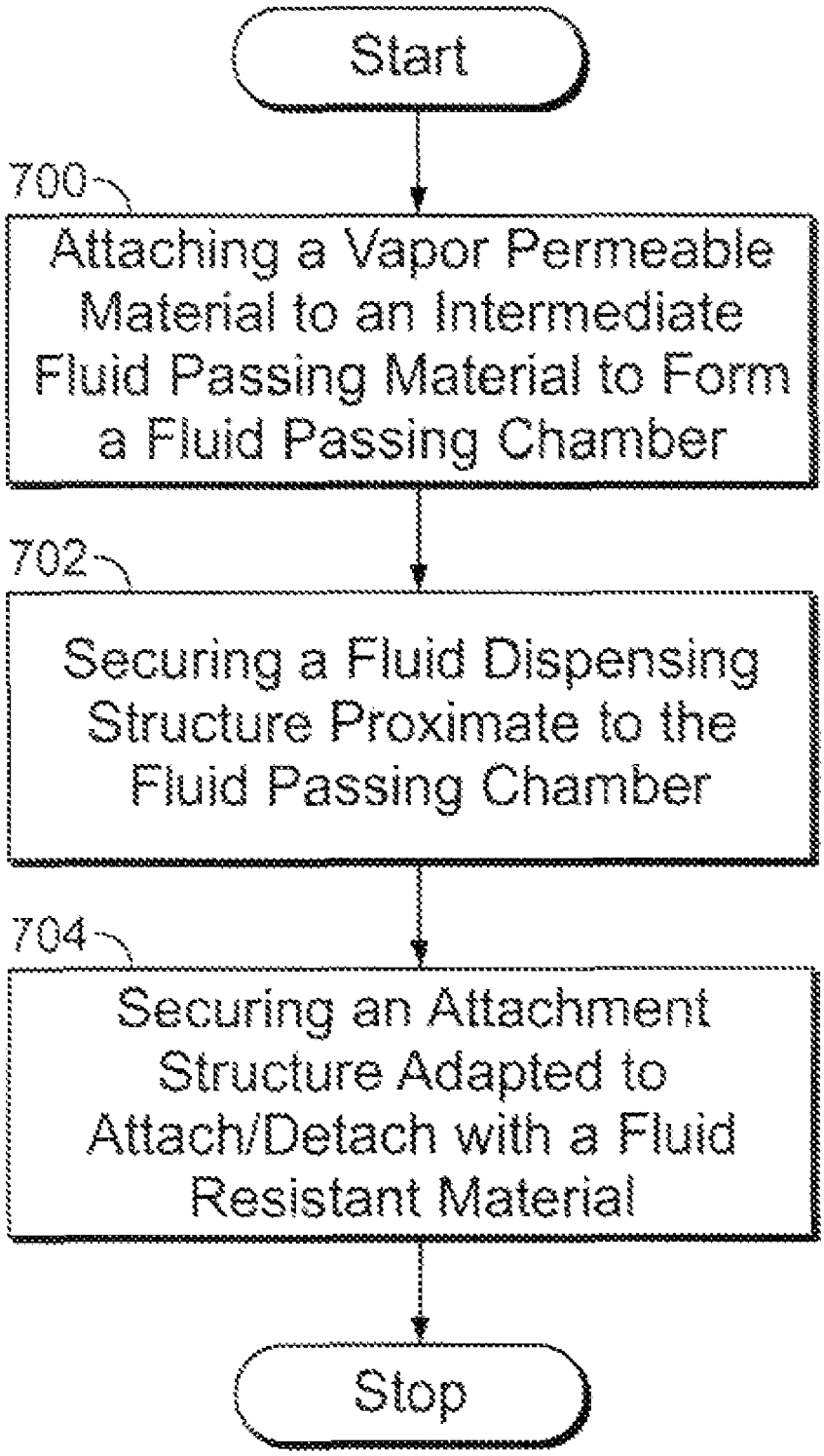
FIG. 7 is a flowchart illustrating one example of a method for making an air distribution support surface product in accordance with one embodiment of the invention.

FIG. 7 illustrates one example of making an air distribution support surface product 16 which includes, as shown in block 700, attaching a vapor permeable material 302 to an intermediate fluid passing material 306 to form a fluid passing chamber. This may be done, for example, by a machine sewing a periphery of the vapor permeable material 302 to the intermediate fluid passing material 306 to form chamber 308. The method also includes, as shown in block 702, securing a fluid dispensing structure, such as structure 314 or any other suitable structure, proximate to the fluid passing chamber 308. This may include, for example, a machine sewing the sleeves 414 to an underside of the chamber 308. As shown in block 704, the method includes securing an attachment structure to a portion of the chamber 308 wherein the attachment structure is adapted to attach/detach with a fluid resistant material 304. This may include, for example, sewing a half portion of a zipper about a periphery of the underside of the fluid passing chamber 308, such as sewing a half zipper to an underside of the intermediate fluid passing material. However, any securing location and securing technique may be employed. The method may also include attaching the fluid resistant material to the fluid passing chamber to form a fluid retention chamber 310.

Figure 8:
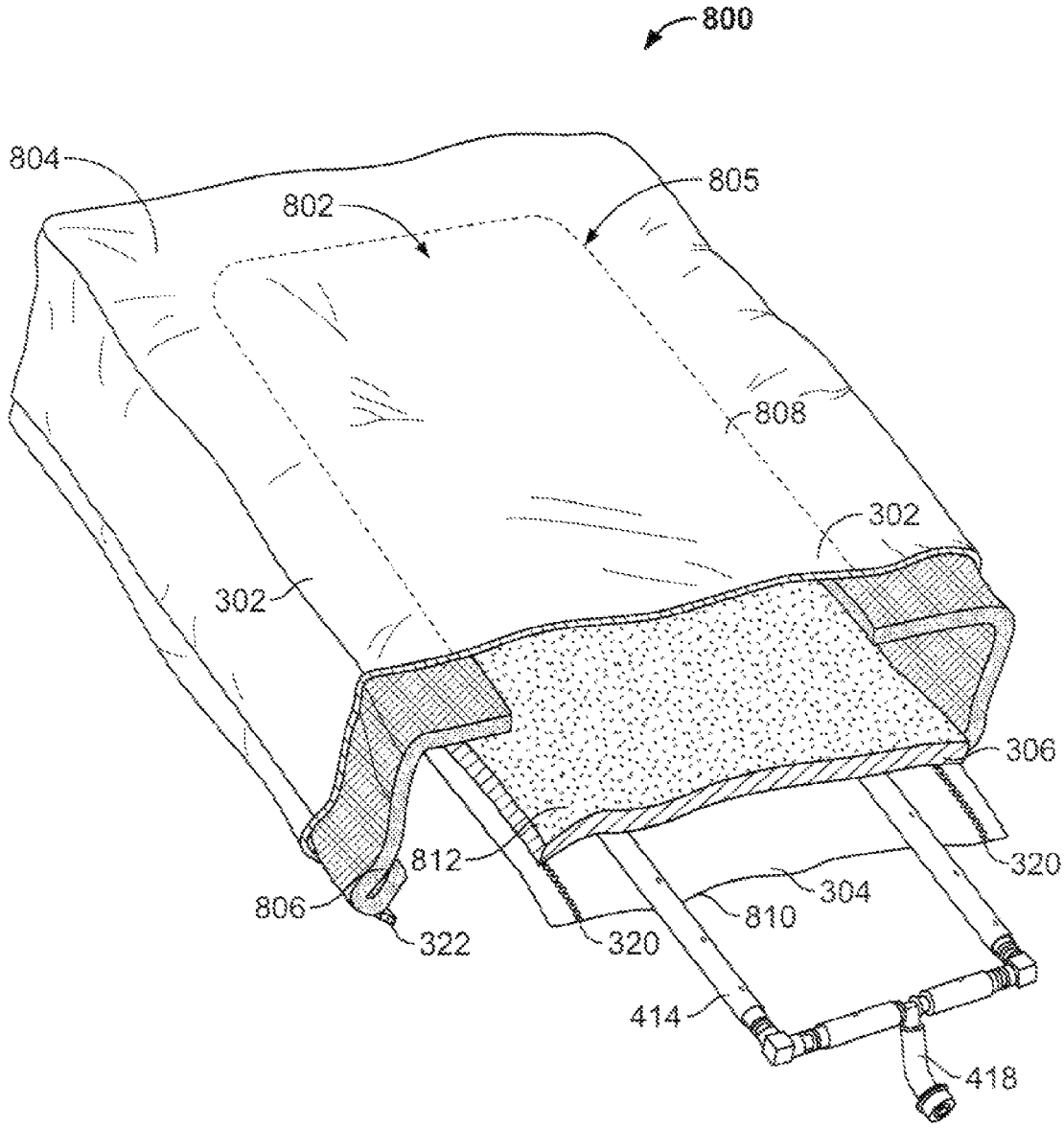
FIG. 8 is a partial perspective view of one example of an air distribution support surface product in accordance with one embodiment of the invention.

FIG. 8 illustrates an example of an air distribution support surface product 800 that has at least one portion thereof 802 configured as an inflatable multi-chamber portion as described above but in addition, includes a different type of structure that is attached to the portion 802. In this example, the additional structure 804 includes a quilting layer 806 covered by the vapor permeable material 302. In this example a vapor permeable portion 808 is made of the vapor permeable material 302, a fluid resistant portion 810 is made of the fluid resistant material 304 and an intermediate fluid passing portion 812 is made of the intermediate fluid passing material 306. As such, the portion 802 is a low air loss area of the type described above within an air distribution support surface product. The portion 804 is made of a different structure which may or may not be a low air loss structure. In this example, the portion 804 is not a low air loss portion and instead is a quilted or padded portion. The low air loss portion 802 in this example, is secured by stitching the periphery of sheets of the vapor permeable material and an intermediate fluid passing portion as described above, The multi-chamber portion 802 is shown to be secured via seam 805 through stitching, fusing or other suitable attachment mechanism to the additional material 804. Similarly, attachment structures are used as noted above to provide a removable fluid resistant potion 810. It will be recognized that multiple and different shaped portions of the multi-chamber configuration 802 may be employed in an air distribution support surface product. The example shown in FIG. 8 is but one example.

The intermediate fluid passing portion 812 is interposed between the vapor permeable portion and the fluid resistant portion to form a plurality of chambers as described above. A fluid intake opening, such as a hole to receive the fluid distribution structure 414, may be placed in the fluid resistant portion 810, as described above. However, it will be recognized that a fluid intake opening can be in any suitable location.

The above products and methods offer improvements to air supported structures which are typically intended for therapeutic purposes. In one example of the above product, air or other suitable vapor is discharged from, for example, a hose or other structure into a confined space inside the product, air passes from the fluid retention chamber and is emitted from an upper or top vapor permeable material. As described above, the air distribution support surface product may be formed from panels or sheets of material with zippers or other attachment mechanisms at their perimeter or other positions that fasten to corresponding zippers (or other structure) on the undersides of a top sheet assembly. A bottom sheet, for example, is not vapor permeable is attached to the top sheet assembly and traps air. The lower panel is removable for laundering or service of the top sheet assembly. An intermediate air passing material serves in one embodiment, as a cushioning material that offers low resistant to air flow. This material may also be a quilted layer with holes therein to allow more air flow as opposed to typical quilted layers or may be noncompressible and formed by fusing multiple layers of nylon sheeting together with holes in each of the layers to allow passing of air. Other structures may also be used.

An air distribution hose is installed within the top sheet assembly and arranged in a U shape against three walls of the top sheet assembly. The base of the U shape tubing is at the user's foot when in use. The base end of the U tubing includes a stub hose with a connector for coupling to a source of pressurized air from an external pump. Hose sections internal to the top sheet assembly are perforated at intervals to discharge the air evenly throughout the chamber 310 of the air distribution support surface product.

It will be recognized that the low air loss top sheet or air distribution support surface product described above may be supplied with fluid by a powered or non-powered external fluid source through any suitable mechanism and that layers of material in the air distribution support surface product may be bonded, sewn, welded, fused separate layers of fabrics or material to form the chambers as described herein. The air distribution support surface product may be a mattress overlay, may serve as a mattress overlay system or fluid mattress replacement system or may be suitable as any support surface as desired. It may be placed on a static support surface or low air loss surface, a turning system, combination thereof or any other suitable surface as desired. It will be recognized that the air distribution support surface product described herein can be any suitable length, thickness, shape or configuration as desired and can help improve air flow to a user's skin to help avoid capillary occlusion which can cause decubitus ulcers or provide different benefits. Other enhancements will also be recognized by those of ordinary skill in the art.

Also, the power control system may also include pressure sensor feedback controls for an entire support surface as known in the art. Among other advantages, blood supply to the skin can be improved. The intermediate fluid passing material serves as a type of spacer layer in one embodiment, that tends to preserve the flatness of the top surface, reduce the tendency to droop into crevices in air cells in a support surface, and is highly breathable creating a moisture free environment decreasing chances of skin maceration. Other advantages will also be recognized.

As shown in one embodiment, the air distribution support surface product consists of three layers or sheets wherein the upper layer that is intended to be close to the user is a breathable fabric layer which forms part of a chamber that gradually releases fluid or air. A middle or intermediate layer allows fluid to move freely between a bottom layer and the top layer or a bottom chamber and an upper chamber. In one example, the bottom layer has a connector with a quick disconnect air connector through which air is supplied to the chambers. It will be recognized that the sheets may be sewn, welded, fused, or otherwise fastened as desired to provide the structure as described herein. In one example, the air distribution support surface product may be assembled by cutting the vapor permeable sheet, the intermediate fluid passing sheet, the tube holding loops, and inner and outer zippers to dimensions and bonded or sewn or welded or fused together. The bottom or fluid resistant material and zipper is cut to dimensions and bonded or sewn or welded or fused together so that the fluid resistant material includes a zipper or other attachment structure to allow it to be attached to the top and intermediate sheets. A fluid input hose assembly is inserted into the loops of the top layer and the bottom layer is fastened to the inner zipper of the top layer to form a complete air distribution support surface product.

Among other advantages, the multiple chamber configuration with the intermediate fluid passing sheet allows air to flow from the fluid retention chamber when the air distribution support surface product is inflated, to the fluid loss chamber and out through the vapor permeable material 302. When a user, for example, lays on top of the air distribution support surface product 16, the intermediate fluid passing material 306 whether compressible or not may still allow air flow to reach the user's skin, if the user's weight effectively collapses the area of the vapor permeable material 302 that is below the user's body since the intermediate fluid passing material allows fluid passage.

The above detailed description of the invention and the examples described therein have been presented for the purposes of illustration and description only and not by limitation. It is therefore contemplated that the present invention cover any and all modifications, variations or equivalents that fall within the spirit and scope of the basic underlying principles disclosed above and claimed herein.

What is claimed is:

1. An air distribution support surface pad comprising:
a vapor permeable portion;
a fluid resistant portion; and
an intermediate fluid passing portion interposed between the vapor permeable portion and the fluid resistant portion to form a plurality of fluid only chambers and operative to pass fluid from one of the plurality of chambers to another of the plurality of chambers.

2. The air distribution support surface pad of claim 1 comprising a fluid intake opening operative to provide fluid to at least one of the plurality of chambers.

3. The air distribution support surface pad of claim 1 wherein the intermediate fluid passing portion has a thickness greater than a thickness of both the vapor permeable portion and the fluid resistant portion.

4. An air distribution support surface pad comprising:
a vapor permeable material;
a fluid resistant material;
an intermediate fluid passing material interposed between the vapor permeable material and the fluid resistant material to form a plurality of fluid only chambers and operative to pass fluid from one of the plurality of chambers to another of the plurality of chambers; and
a fluid intake opening operative to provide fluid to at least one of the plurality of chambers.

5. The air distribution support surface pad of claim 4 wherein the intermediate fluid passing material has a thickness greater than a thickness of both the vapor permeable material and the fluid resistant material.

6. The air distribution support surface pad of claim 4 wherein the intermediate fluid passing material includes an air diffusion structure defined by at least a first surface and an opposing second surface and wherein the first surface comprises larger fluid openings than fluid openings in the second surface.

7. The air distribution support surface pad of claim 4 wherein the plurality of chambers comprise:
a fluid retention chamber formed by the fluid resistant material and the intermediate fluid passing material; and
a fluid loss chamber formed by the vapor permeable material and the intermediate fluid passing material.

8. The air distribution support surface pad of claim 7 comprising a fluid dispensing structure, in fluid communication with the fluid intake opening and positioned to dispense fluid into the fluid retention chamber.

9. The air distribution support surface pad of claim 8 wherein the fluid dispensing structure is located about a periphery of the fluid retention chamber.

10. The air distribution support surface pad of claim 8 wherein the fluid dispensing structure is comprised of fluid passages having fluid openings to allow fluid to be dispensed from the passage.

11. The air distribution support surface pad of claim 8 wherein the fluid dispensing structure is comprised of at least a portion of a flexible tube that defines the fluid openings and a tube holding structure that holds the flexible tubing structure within the fluid retention chamber.

12. The air distribution support surface pad of claim 4 wherein the vapor permeable material and the intermediate fluid passing material are in sheet form and are operatively secured to each other and form a top sheet assembly and wherein the top sheet assembly comprises a first top sheet assembly attachment structure that provides removable attachment with the fluid resistant material.

13. The air distribution support surface pad of claim 11 wherein the top sheet assembly further comprises a second top sheet assembly attachment structure adapted to attach to a support surface layer.

14. An air distribution support surface product comprising:
a vapor permeable nylon sheet;
a fluid resistant nylon sheet; and
an intermediate fluid passing sheet interposed between the vapor permeable sheet and the fluid resistant sheet to form a plurality of chambers wherein the intermediate fluid passing sheet is comprised of compressible material and has a thickness greater than the thickness of the vapor permeable nylon sheet and the fluid resistant nylon sheet and operative to pass fluid from one of the plurality of chambers to another of the plurality of chambers.

15. A low air loss pad assembly comprising:
a vapor permeable portion;
a fluid passing portion attached to the vapor permeable portion to form an inflatable and
compressible fluid-only fluid loss chamber and
wherein the fluid passing portion is comprised of an air diffusion structure defined by at least a first surface and an opposing second surface and wherein the first surface comprises larger fluid openings than fluid openings in the second surface.

16. The low air loss pad assembly of claim 15 comprising an attachment structure adapted to attach/detach with a fluid resistant portion.

17. A bed comprising:
a mattress support structure;
a mattress supported by the mattress support structure; and
an air distribution support surface pad coupled with the mattress comprising:
a vapor permeable portion;
a fluid resistant portion; and
an intermediate fluid passing portion interposed between the vapor permeable portion and the fluid resistant portion to form a plurality of fluid only chambers as part of the air distribution support surface product and operative to pass fluid from one of the plurality of chambers to another of the plurality of chambers.

18. The bed of claim 17 wherein the air distribution support surface product comprises a fluid intake opening operative to provide fluid to at least one of the plurality of chambers.

19. The bed of claim 18 comprising a controllable fluid source operatively mounted therewith to provide fluid to the air distribution support surface product.

20. An air distribution support surface product comprising:

a vapor permeable portion;

a fluid resistant portion;

an intermediate fluid passing portion interposed between the vapor permeable portion and the fluid resistant portion to form a plurality of chambers and operative to pass fluid from one of the plurality of chambers to another of the plurality of chambers; and wherein the intermediate fluid passing portion has a thickness greater than a thickness of both the vapor permeable portion and the fluid resistant portion.

21. An air distribution support surface product comprising:

a vapor permeable material;

a fluid resistant material;

an intermediate fluid passing material interposed between the vapor permeable material and the fluid resistant material to form a plurality of chambers and operative to pass fluid from one of the plurality of chambers to another of the plurality of chambers;

a fluid intake opening operative to provide fluid to at least one of the plurality of chambers; and wherein the intermediate fluid passing material includes an air diffusion structure defined by at least a first surface and an opposing second surface and wherein the first surface comprises larger fluid openings than fluid openings in the second surface.

22. An air distribution support surface product comprising:

a vapor permeable material;

a fluid resistant material;

an intermediate fluid passing material interposed between the vapor permeable material and the fluid resistant material to form a plurality of chambers and operative to pass fluid from one of the plurality of chambers to another of the plurality of chambers;

a fluid intake opening operative to provide fluid to at least one of the plurality of chambers; and wherein the vapor permeable material and the intermediate fluid passing material are in sheet form and are operatively secured to each other and form a top sheet assembly and wherein the top sheet assembly comprises a first top sheet assembly attachment structure that provides removable attachment with the fluid resistant material.

23. A low air loss sheet assembly comprising:

a vapor permeable portion;

a fluid passing portion attached to the vapor permeable portion to form an inflatable and compressible fluid loss chamber; and wherein the intermediate fluid passing portion is comprised of an air diffusion structure defined by at least a first surface and an opposing second surface and wherein the first surface comprises larger fluid openings than fluid openings in the second surface.

* * * * *